US007883152B2

(12) United States Patent
Griggs

(10) Patent No.: US 7,883,152 B2
(45) Date of Patent: Feb. 8, 2011

(54) READY TO ASSEMBLE ADJUSTABLE BAR STOOL AND METHOD FOR PACKAGING SAME

(76) Inventor: Billy Joe Griggs, 3030 Minor Hill Hwy., Pulashi, TN (US) 38478

( * ) Notice: Subject to any disclaimer, the term of this patent is extended or adjusted under 35 U.S.C. 154(b) by 118 days.

(21) Appl. No.: 12/029,819

(22) Filed: Feb. 12, 2008

(65) Prior Publication Data

US 2009/0200438 A1 Aug. 13, 2009

(51) Int. Cl.
*A47C 7/00* (2006.01)

(52) U.S. Cl. ..... 297/440.2; 297/440.21; 297/440.14

(58) Field of Classification Search ..... 297/440.1, 297/440.14, 440.15
See application file for complete search history.

(56) References Cited

U.S. PATENT DOCUMENTS

| | | | | |
|---|---|---|---|---|
| 3,177,035 | A * | 4/1965 | Halstrick | 297/451.1 |
| 4,998,774 | A * | 3/1991 | Huff et al. | 297/461 |
| 7,404,607 | B2 * | 7/2008 | Crue | 297/440.1 |
| 2001/0052723 | A1 * | 12/2001 | Wu | 297/440.1 |
| 2006/0284469 | A1 * | 12/2006 | Lowsky | 297/440.1 |
| 2008/0143166 | A1 * | 6/2008 | de Oliveira | 297/440.14 |

* cited by examiner

*Primary Examiner*—Sarah B McPartlin
(74) *Attorney, Agent, or Firm*—David W. Barman; Robert M. Schwartz

(57) ABSTRACT

A bar stool system having a first assembled configuration for seating and a second unassembled configuration for storage and shipping, having a horizontal seat, a support frame having leg assembly members and interchangeable legs that assemble quickly and disassemble into a configuration that optimizes space when shipped.

3 Claims, 5 Drawing Sheets

READY TO ASSEMBLE ADJUSTABLE BAR STOOL AND METHOD FOR PACKAGING SAME

BACKGROUND OF THE INVENTION

The present invention relates generally to ready-to-assemble ("RTA") furniture. More specifically, the present invention relates to RTA bar stools configured for rapid assembly to a fully assembled state after shipping and storage stages.

BRIEF SUMMARY OF THE INVENTION

The present invention is a bar stool constructed and arranged for minimizing packaging volume for rapid assembly to a fully assembled state with minimal effort and tools.

In one embodiment, the present invention is a bar stool system having a first assembled configuration for seating and a second unassembled configuration for storage and shipping.

The assembly has a horizontal seat, a support frame having leg assembly members and interchangeable legs. The assembly may be configured with three, four, or five support frame members, as desired. Preferably, the interchangeable legs attach to the lower portion of the support frame in a male-female connecting arrangement. The interchangeable legs may have varying sizes shapes and other configurations that may be selected as desired by a user.

In one preferred embodiment an interchangeable leg is provided such that the assembled barstool may be used as a conventional counter height stool.

In an alternative embodiment, a longer interchangeable leg may be used such that the stool of the present invention resembles that of a conventional barstool. A conventional barstool is configured to a greater height than that of a conventionally used counter height stool.

The unassembled configuration is substantially rectangular. In order to achieve the substantially rectangular configuration, the interchangeable legs must be removed from their respective leg frames.

The assembly also has a support ring and a foot ring for structural support. The support ring is typically positioned on the upper portion of the assembly below the seat. The foot ring is typically positioned on the lower portion of the assembly.

Preferably, the support frame circumferraly attaches to the support ring.

Also contemplated are methods of shipping Ready to Assemble (RTA) bar stool assemblies with interchangeable legs having the steps of:

(a) providing RTA components of comprising:

(i) a horizontal seat;

(ii) support frame having leg assembly members; and (iii) interchangeable legs;

wherein said interchangeable legs attach to the lower portion of the support frame by a male-female connection (b) arranging said RTA components such that said components form a rectangular configuration;

(b) packaging said RTA furniture into a conventional shipping container such that each unit forming said rectangular frame efficiently utilizes the available shipping space of a conventional shipping container.

DETAILED DESCRIPTION OF THE INVENTION

Figure 1:
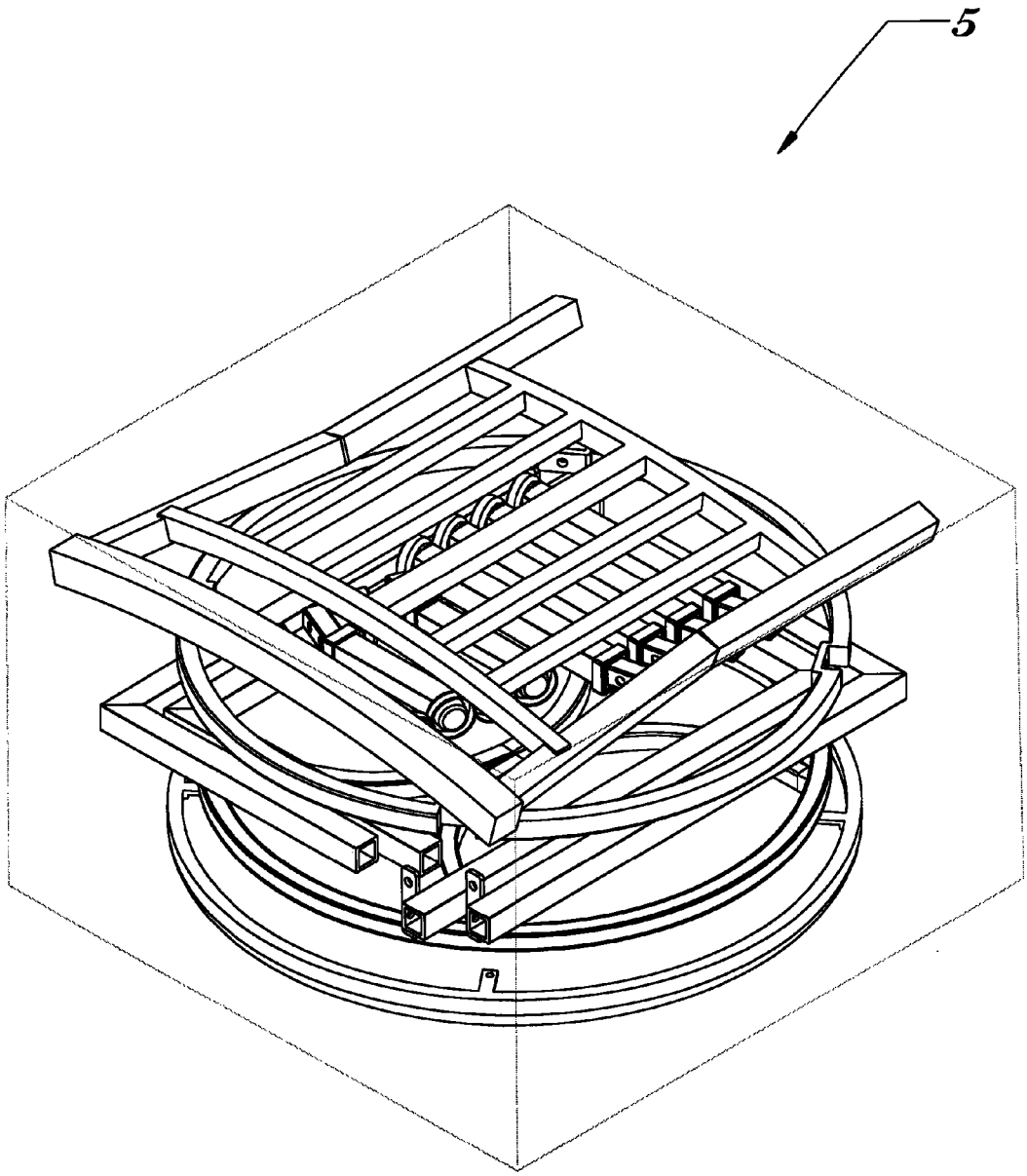
FIG. 1 shows a perspective view of the unassembled configurations.

Barstool system 5 has frame assembly 50 that supports seat 70. Each individual frame assembly 50 is arranged circumferrally around support ring and 40 and foot ring 60. Mounting screws 80 secure foot ring 60 to each frame assembly 50 at frame assembly mounting support 36. Each lower portion of frame assembly 50 has a female cavity 34 that receives male connector 32 on interchangeable leg 30. Interchangeable leg 30 may have protective cap 31 affixed to the lower end of interchangeable leg 30. Barstool system 5 may optionally have back assembly 10 that can be secured to either seat 70 or any one or more of frame assembly members 50 by any acceptable securing mechanism as are commonly known such as, but not limited to. Mounting screws.

As depicted in FIG. 1, barstool assembly 5 may be disassembled and contained within a substantially rectangular solid such as a typical shipping box or container.

Figure 2:
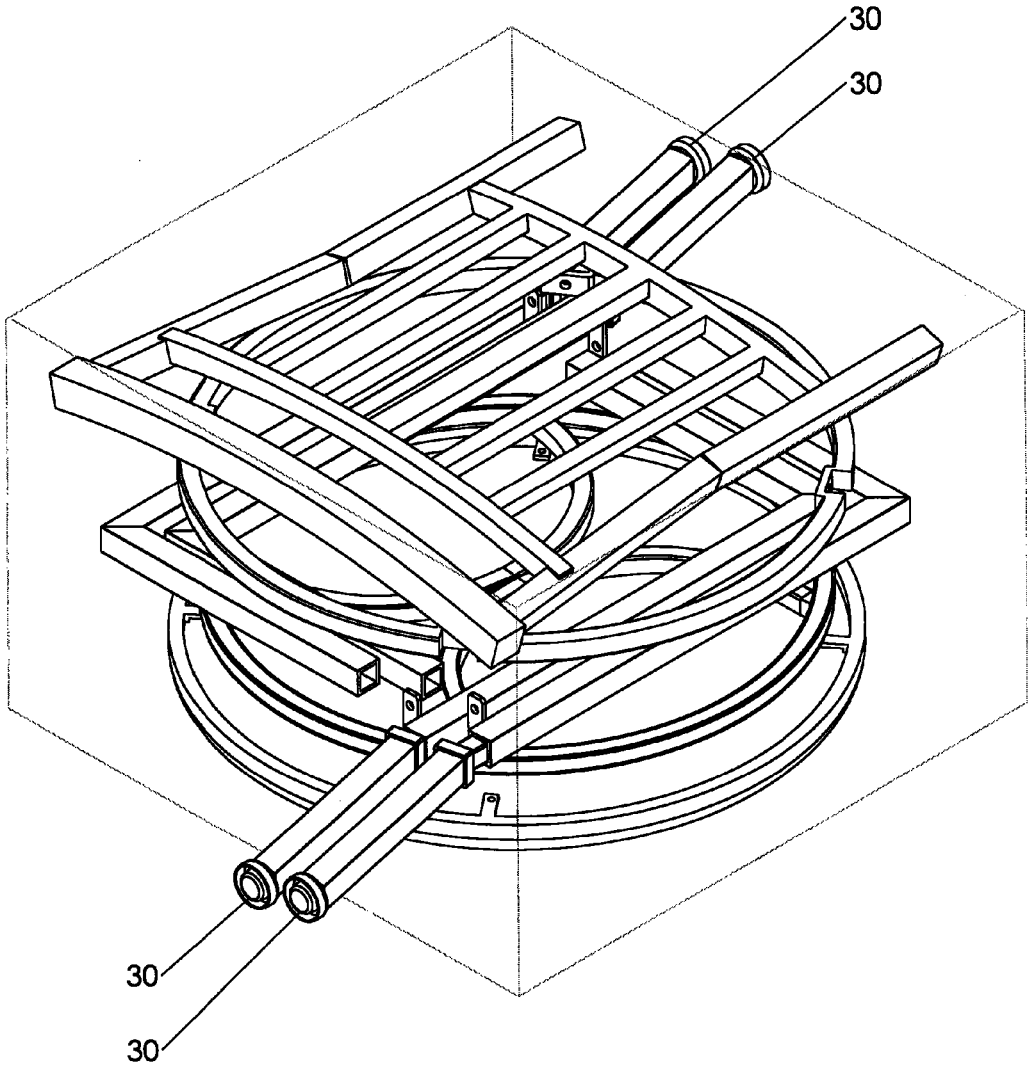
FIG. 2 shows a perspective view of the unassembled configurations also showing how the interchangeable leg is removed to arrange the components in a substantially rectangular manner.
Figure 3:
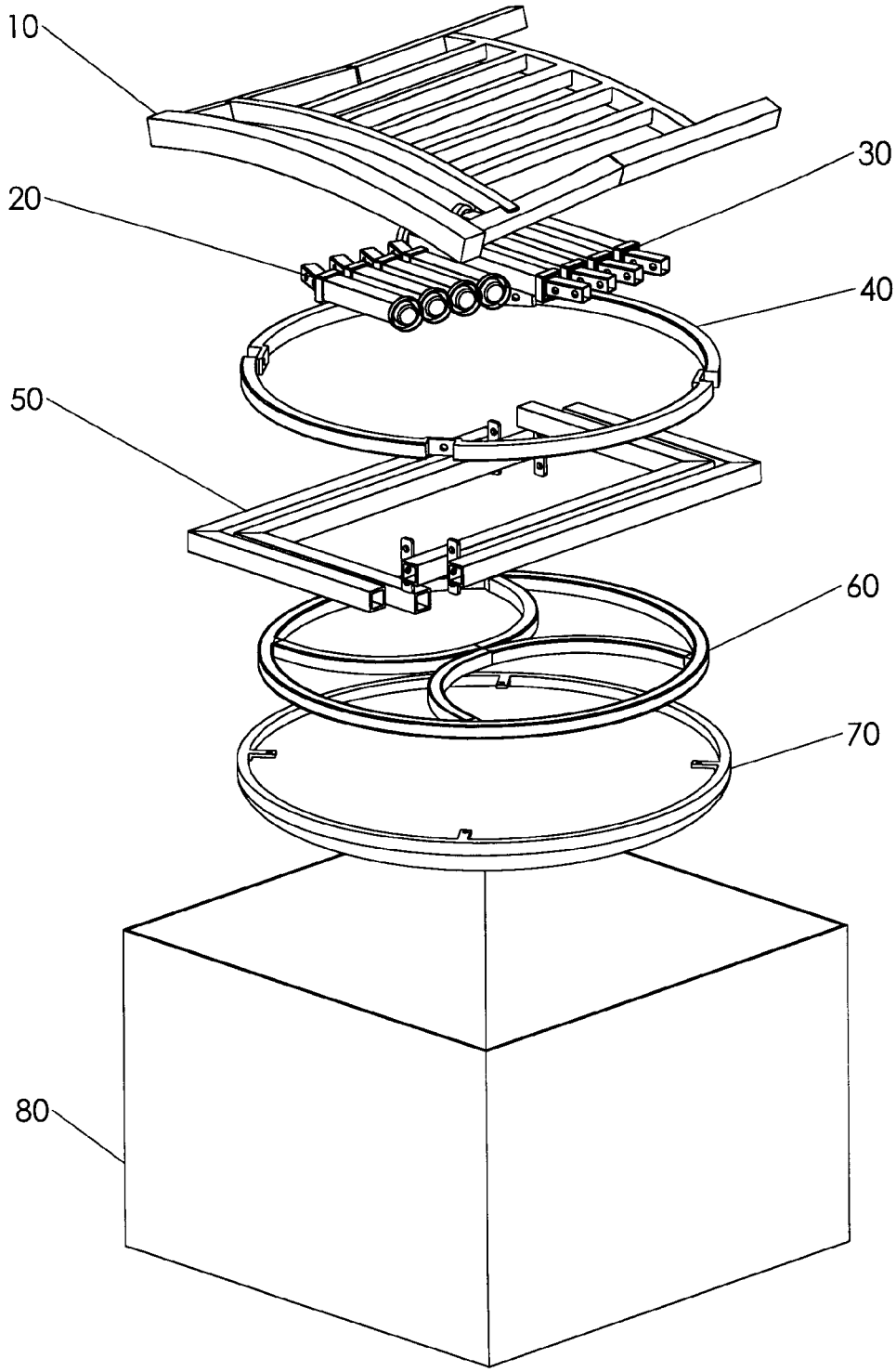
FIG. 3 shows the disconnected arrangement removed from a rectangular container.
Figure 4:
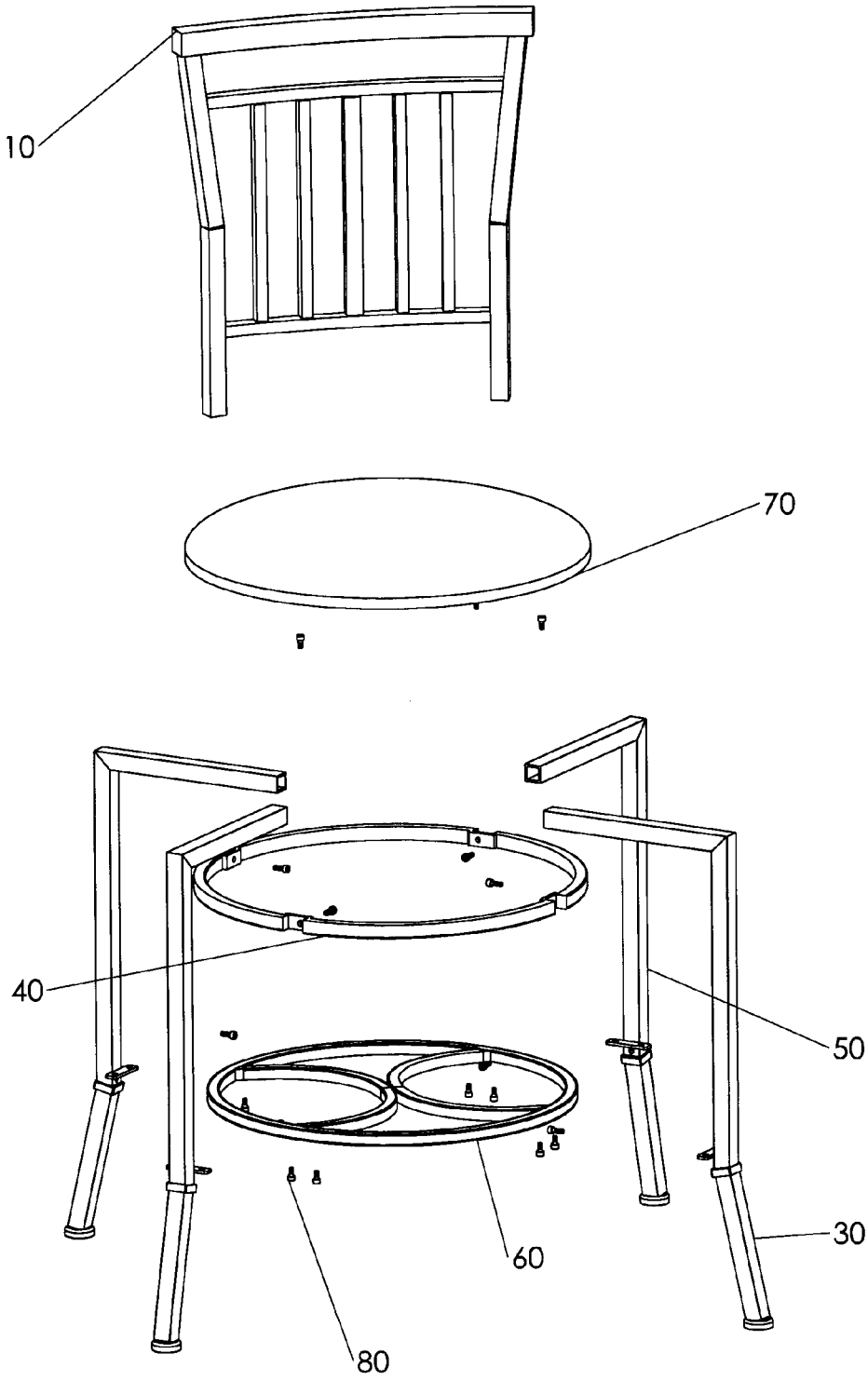
FIG. 4 shows a disassembled view of the components.

Interchangeable legs 30 are preferably removed from the frame assembly 50 prior to shipping because, as seen in FIG. 2, interchangeable legs 30, when connected to frame assembly 50, extend beyond the periphery of the desired substantially rectangular configuration.

Barstool system 5 may be provided with interchangeable legs 30 and interchangeable legs 20. System 5 may be utilized with many types of interchangeable legs as desired by the user. The interchangeable legs may have such features as different lengths, different widths, different decorative surface features, wheels or casters, and the like. Barstool system 5, with the aforementioned interchangeable leg features may be shipped with a plurality of different interchangeable legs that may be selected for use by a particular user when system 5 is assembled.

Figure 5:
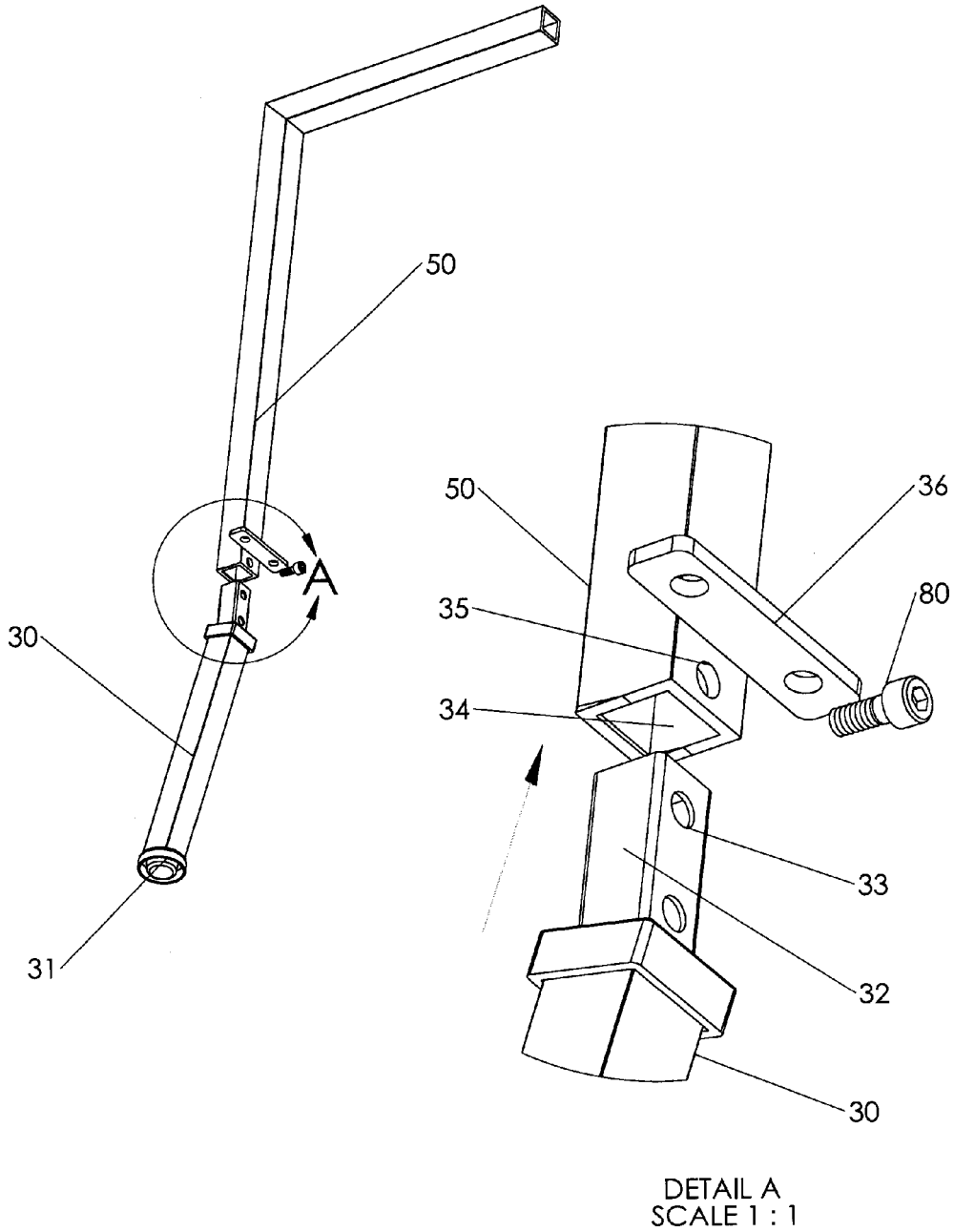
FIG. 5 shows a close up of the interchangeable leg and male-female connection.

Each interchangeable leg provided with system 5, will have a male connector 32 that pairs with the female connector cavity 34 of frame assembly 50. As shown in FIG. 5, detail A, the arrow indicates the insertion path of male connector 32 into the female cavity 34. Interchangeable leg 30 may be secured to frame assembly 50 by any acceptable means as is commonly known. In one embodiment, male connector 32 has an orifice 33 that pairs with orifice 35 on frame assembly 50. A mounting screw 80 may then pass through orifice 35 and orifice 33 to securely hold adjustable leg 30 in place on frame assembly 50.

In assembling a preferred embodiment, the components are separated and the frame assembly 50 is placed in an upright position, e.g. positioned upright so as to receive the component parts and be usable upon assembly. Each frame assembly 50 is connected to each of support ring 40 and foot ring 60 through use of screws 80. In one embodiment, mounting screws 80 interact with nuts permanently mounted into incorporated orifices into each of said frame assembly 50 support ring 40 and foot ring 60.

The bar stool system of the present invention provides not only a cost savings in shipping, but also a savings in labor for assembling. Once the article is unpacked from shipping configuration; it comprises simple components and assembles quickly.

The system of the present invention is advantageous because the interchangeable leg extension allows a user to select a counter height stool, chair, or a bar stool. Typically, the counter height stool and bar stool are separate items. The system of the present invention allows a user to purchase a single stool and interchange the legs as desired. This reduces the number of stools needed for display inventory and further allows display inventories to demonstrate varying styles without having to display separate chair height, counter height, and bar stool models.

Assembly of the system of the present invention on a commercial scale is also economized because any assembly line processes can be done quickly.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A bar stool system comprising:

(a) a first assembled configuration for seating;

(b) a second unassembled configuration for storage and shipping, comprising:

(i) a horizontal seat;

(ii) support frame circumferentially attachable to a support ring and a foot ring, said support frame having leg assembly members, wherein said leg assembly members are constructed with openings on a lower end of said members to be female connectors to receive interchangeable legs in a male-female connecting arrangement, said openings are substantially coplanar with a bottom surface of said foot ring when said system is in the first assembled configuration;

(iii) interchangeable legs;

wherein said interchangeable legs have a male attachment configuration on an upper end to mate with the openings on said leg assembly members of said support frame, said interchangeable legs and said leg assembly members abut in a single horizontal plane that is substantially coplanar with a bottom surface of said foot ring when said system is in the first assembled configuration.

2. The furniture system of claim 1, wherein said unassembled configuration is substantially rectangular.

3. A method of shipping Ready to Assemble (RTA) bar stool with interchangeable legs comprising the steps of:

(a) providing RTA components of comprising:

(i) a horizontal seat;

(ii) support frame circumferentially attachable to a support ring and a foot ring, said support frame having leg assembly members, wherein said leg assembly members are constructed with openings on a lower end of said members to be female connectors to receive interchangeable legs in a male-female connecting arrangement, said openings are substantially coplanar with a bottom surface of said foot ring when said RTS components are in a first assembled configuration;

(iii) wherein said interchangeable legs have a male attachment configuration on an upper end to mate with the openings on said leg frame, said interchangeable legs and said leg assembly members abut in a single horizontal plane that is substantially coplanar with a bottom surface of said foot ring when said system is in the first assembled configuration;

(b) arranging said RTA components such that said components form a rectangular configuration;

(c) packaging said RTA furniture into a conventional shipping container such that the rectangular configuration efficiently utilizes the available shipping space of the conventional shipping container.

* * * * *